United States Patent [19]

Hallam et al.

[11] 4,232,793

[45] Nov. 11, 1980

[54] CAR COUPLING ARRANGEMENT FOR RAILWAY PASSENGER CARS

[75] Inventors: Keith J. Hallam, Merrillville; Dennis B. Marsden, Griffith, both of Ind.

[73] Assignee: Pullman Incorporated, Chicago, Ill.

[21] Appl. No.: 31,241

[22] Filed: Apr. 18, 1979

[51] Int. Cl.[3] ..... B61G 3/04

[52] U.S. Cl. ..... 213/43; 213/8; 213/20

[58] Field of Search ..... 213/1 R, 8, 20, 76, 213/166, 43, 76, 151, 186

[56] References Cited

U.S. PATENT DOCUMENTS

| | | | |
|---|---|---|---|
| 1,590,489 | 6/1926 | Ballou | 213/186 |
| 1,912,863 | 6/1933 | Simmons | 213/186 |
| 3,280,990 | 10/1966 | Jeffrey et al. | 213/76 |
| 3,561,611 | 2/1971 | Hawthorne et al. | 213/8 |
| 3,751,089 | 8/1973 | Lefeuvre | 213/1 |
| 3,834,553 | 9/1974 | DePenti | 213/166 |
| 3,841,496 | 10/1974 | Hawthorne | 213/43 |
| 3,857,495 | 12/1974 | Kaufhold | 213/151 |

*Primary Examiner*—Richard A. Bertsch

*Attorney, Agent, or Firm*—Richard J. Myers; Stephen D. Geimer

[57] ABSTRACT

A coupler arrangement for rapid transit passenger cars includes a self-centering coupler shank having limited horizontal and vertical swinging movement about a spherical bearing structure. The arrangement includes first and second shock absorbing mechanisms sequentially effective. A pin type coupler includes a locking arrangement on the coupler structure engageable with the coupler pin.

16 Claims, 7 Drawing Figures

FIG. 6
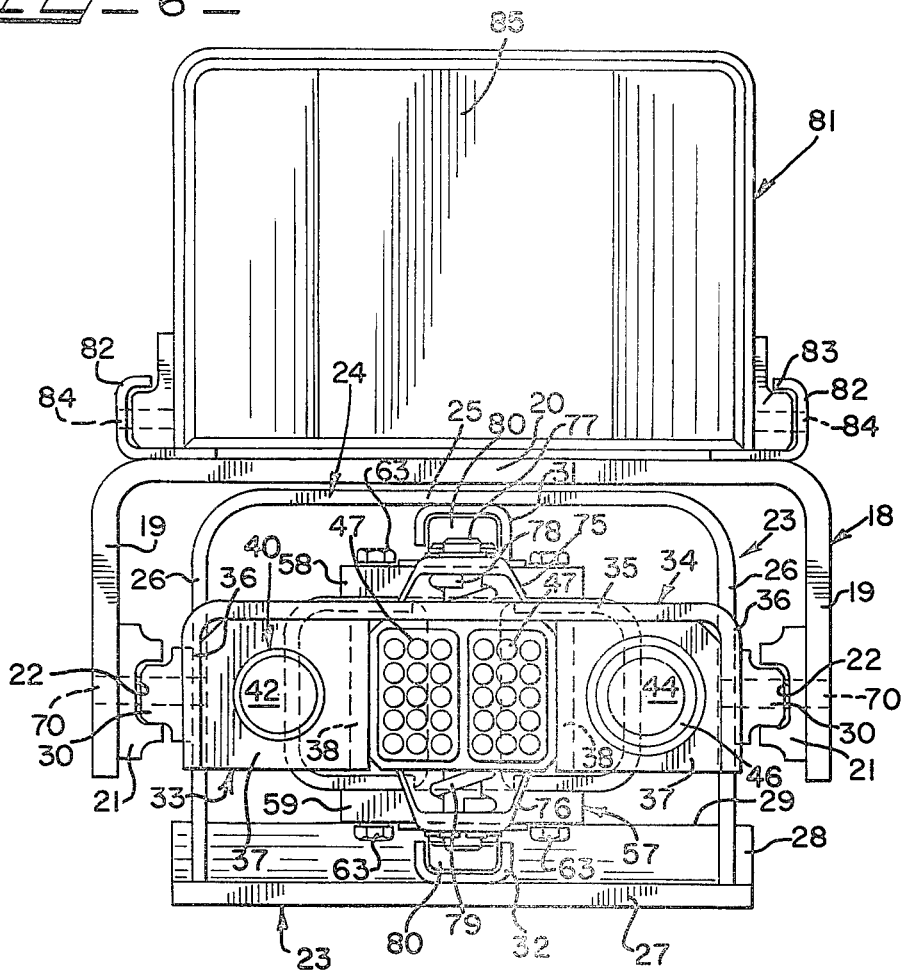
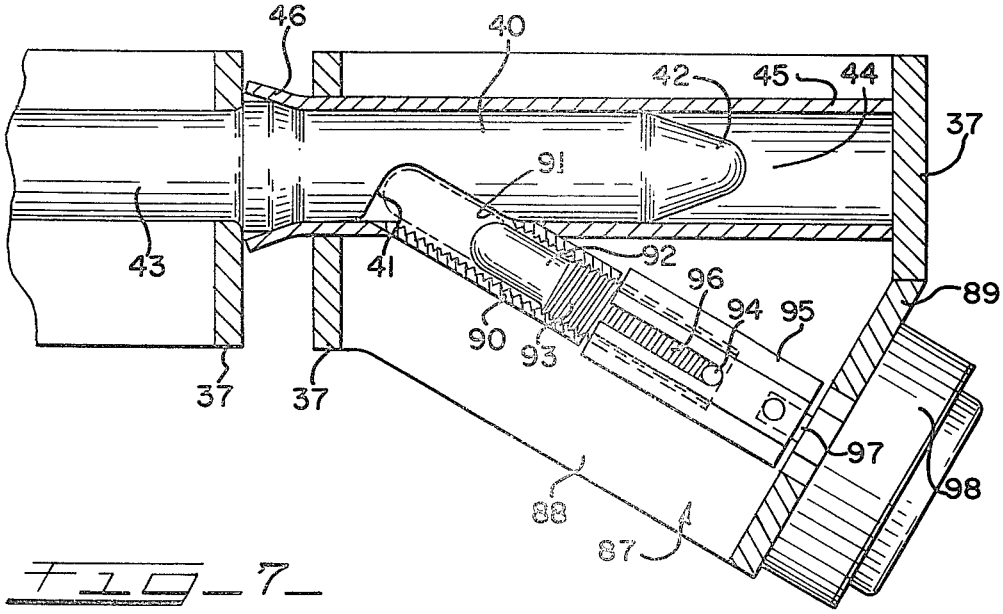
FIG. 7

CAR COUPLING ARRANGEMENT FOR RAILWAY PASSENGER CARS

BACKGROUND OF THE INVENTION

1. Field of the Invention

The present invention relates generally to railway passenger cars of the rapid transit type and more specifically relates to an improved coupler arrangement therefor.

2. Description of the Prior Art

U.S. Pat. Nos. 3,561,611 and 3,841,496 illustrate a railway car impact absorbing devices suitable for use with a knuckle-type car coupler. U.S. Pat. No. 3,751,089 shows a frangible shock absorbing bumper adapted for use on automotive vehicles. U.S. Pat. No. 3,834,553 illustrates an uncoupling mechanism for a knuckle-type railway coupler. The present invention is an improvement over these designs and provides a novel arrangement for coupling adjacent railcars and for protecting them from impact shocks and stresses occuring as a result of high speed impacts.

SUMMARY OF THE INVENTION

A coupler arrangement includes a swinging coupler housing having a pin-type coupler projecting outwardly therefrom and including a laterally spaced receptacle adapted to receive in mating engagement the projecting coupler pin of a connected car. The coupler housing is connected to a coupler shank which may be pivotedly moved about horizontal and vertical axis to provide for limited swinging movement of the coupler housing. The swinging movement is achieved by virtue of a pivot shaft vertically connected to a pivot support member having a yoke and vertical shaft arrangement with a spherical bearing seated in swiveling engagement with a cylindrical bearing portion of the coupler shank. The pivot support member is slidingly supported on a tray structure which also supports a fluid extensible device or hydraulic cushion in turn pivotedly connected to the pivot member for absorbing limited longitudinal shocks arising during the coupling operation.

The arrangement also includes upper and lower arms which include a vertical shaft connected to the forward end of the coupler shank and to the coupler housing, the same including spring devices which will center or return the coupler housing to a vertically centered position. The arrangement further includes a horizontally extending shaft which is suitably supported on the pivot support member and which limits the horizontal swinging movement of the coupler housing and returns the same to a center position.

The arrangement also includes a second cushioning structure which is supported above the tray structure supporting the fluid extensible device or hydraulic cushion. The second cushioning structure is adapted to absorb high speed impacts and the shock occurring therefrom in that the tray structure, during such impacts, will be disengaged from the sill structure of the car by the breakage of a shear pin and whereupon the second cushioning structure becomes effective to absorb the higher speed impacts. This then results in lesser injury or damage to the coupler structure and first cushioning means.

The arrangement also includes improved locking devices for locking the coupler pins securely within their respective receptacles. The locking devices include an electric motor which is actuated to rotate a sleeve in turn rotating a threaded cylindrical stop within a threaded tube thereupon moving the stop into engagement with a recess or bayonet-type slot provided in the tubular pin whereupon the tubular pin is securely locked in position within the receptacle of the coupler.

BRIEF DESCRIPTION OF THE DRAWINGS

FIG. 6 is a front elevational view taken substantially along the lines 6—6 of FIG. 4;

FIG. 7 is a cross-sectional view taken substantially along the line 7—7 of FIG. 2 disclosing a locking arrangement for a coupler pin.

DESCRIPTION OF THE PREFERRED EMBODIMENT

Figure 1:
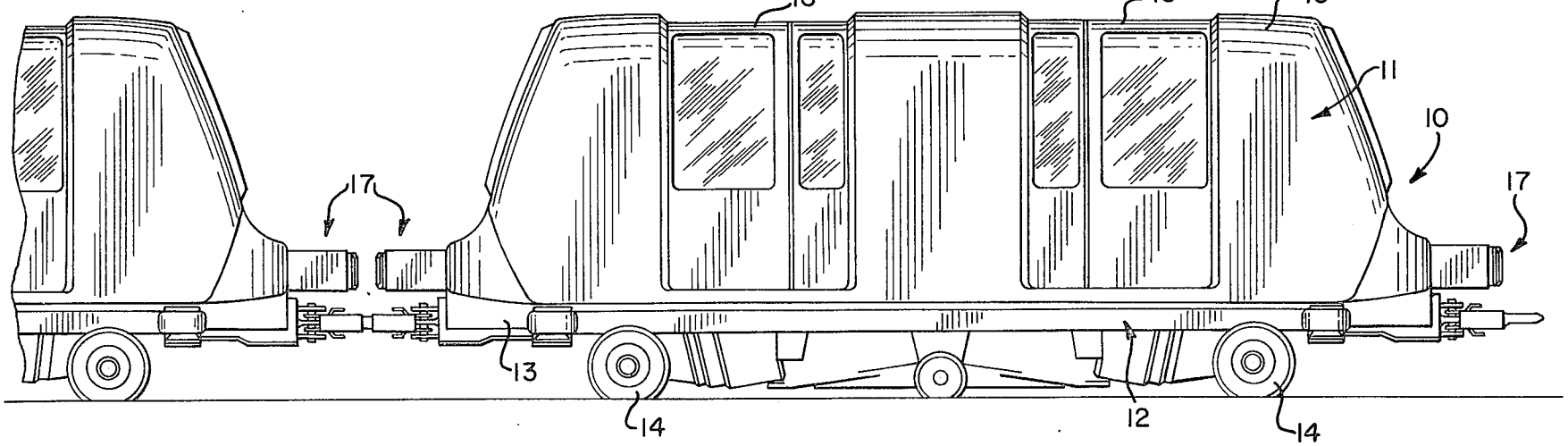
FIG. 1 is a side elevational view of a pair of rapid transit passenger vehicles coupled together by the improved coupling mechanism.

Referring particularly to FIG. 1, a rapid transit passenger car 10 comprises a car body 11 including an underframe structure 12 having a structural center sill 13 suitably supported on propulsion wheels 14. The car 10 may be of the modern high speed type having numberous vehicles connected thereto or may consist of intercoupled units of several vehicles operating under modern computerized systems. The car body 11 may include doors 16 and is provided at opposite ends of the center sill structure 13 with front and rear coupler assemblies 17. As best shown in FIG. 6, frame structures or supporting frames 18 are provided at opposite ends of the sill structure 13, are of channel shape and include vertical flanges 19 and a horizontal web 20. Slide guides 21 are provided on the inner surfaces of the flanges 19 and include grooves 22.

Figures 3, 5:
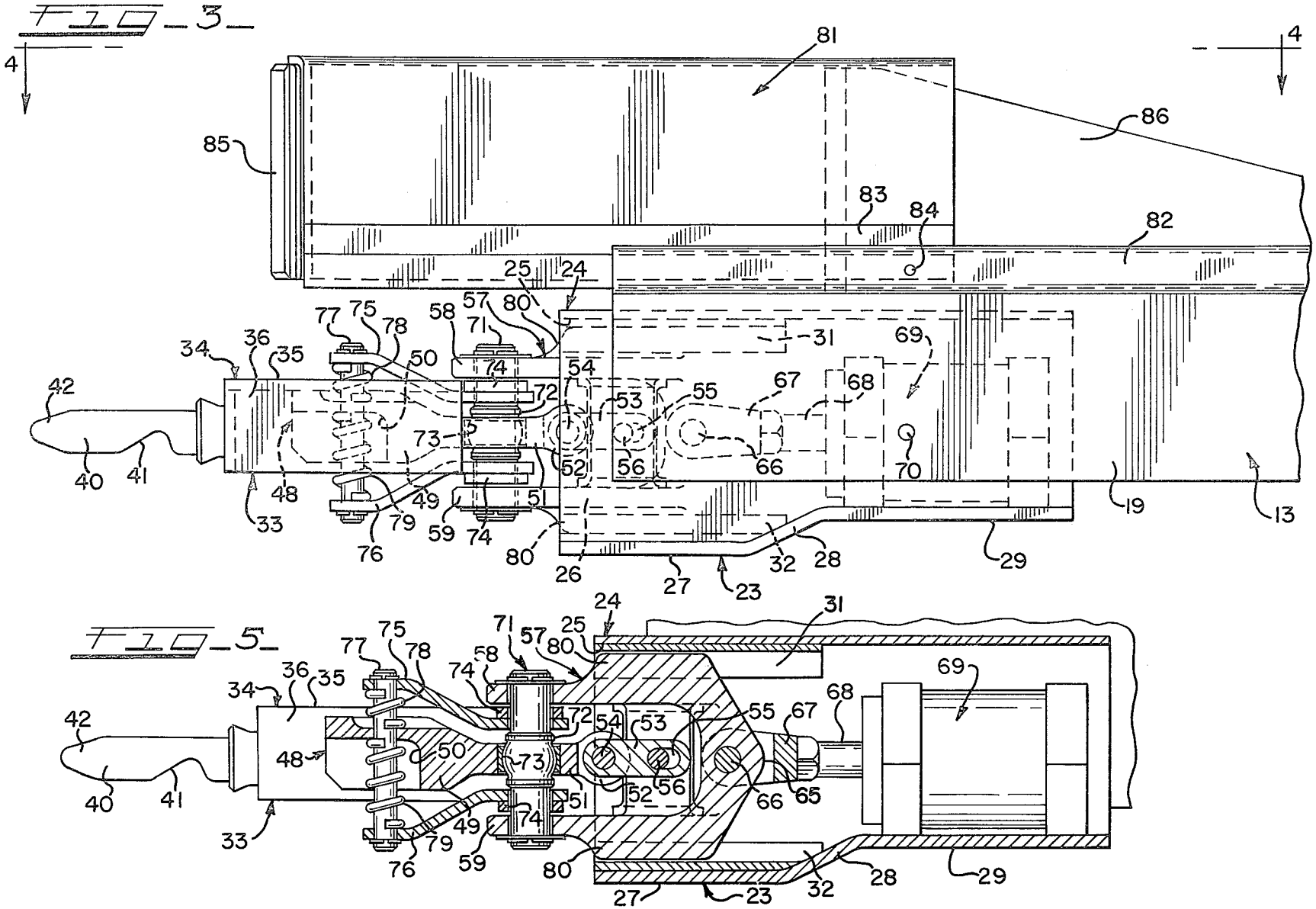
FIG. 3 is a side elevational view disclosing a portion of the center sill of a car having at its outer end a novel coupler arrangement.
FIG. 5 is a cross-sectional view taken substantially along the line 5—5 of FIG. 4.

A tray structure 23 comprises a channel shape member 24 having a horizontal web 25 and vertical flanges 26. A tray structure 23 includes a lower support platform 27 consisting of a tapering portion 28 connected to an upper flat platform portion 29 as best shown in FIG. 3. The flanges 26 have supported thereon at the outer surfaces thereof slide supports 30 which are engaged within the grooves 22 of the slide guides 21 on the flanges 19. The web 25 also is provided with an upper channel guide 31 projecting downwardly and the support platform 27 is provided with a similar, aligned lower channel guide 32 projecting in an upward direction.

Figure 4:
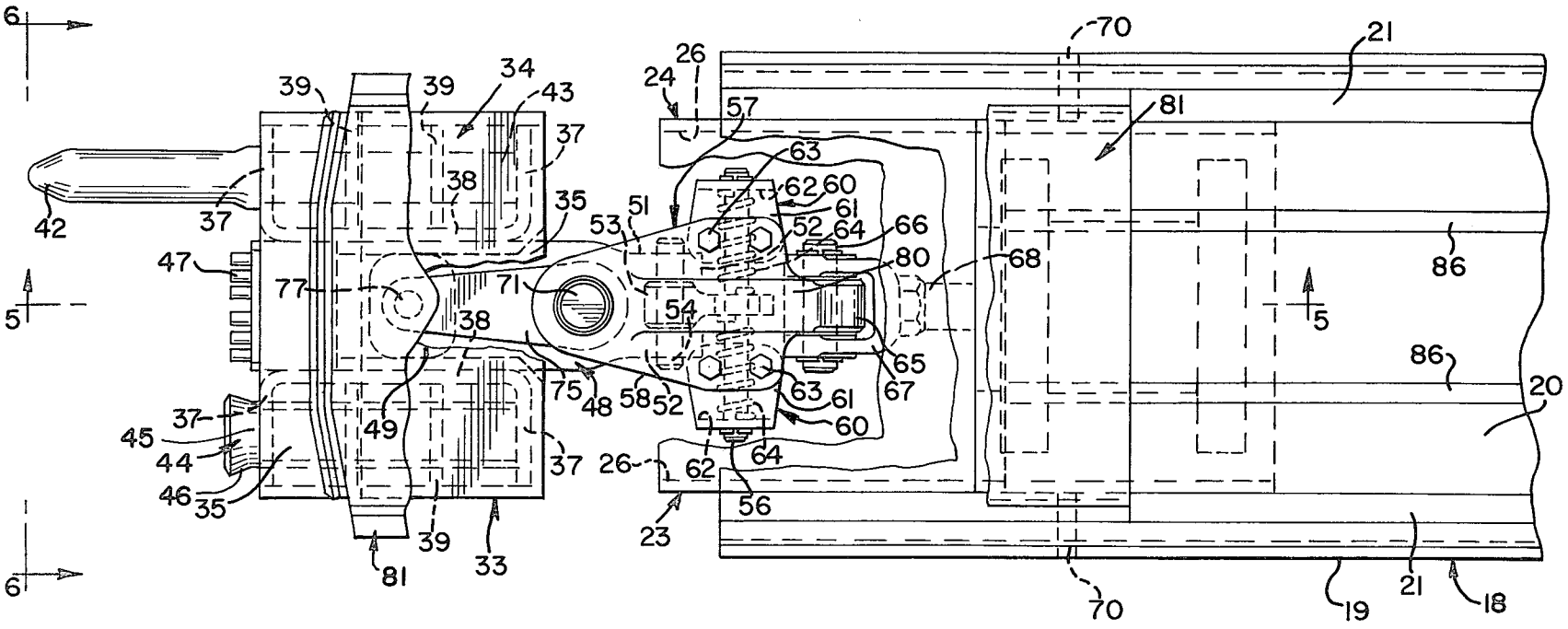
FIG. 4 is a plan view, with portions broken away, taken substantially along the lines 4—4 of FIG. 3.

The coupler assemblies 17 each includes a box-like housing 33 having a channel shaped member 34, of which includes a horizontal web 35 and vertical flanges 36. As best shown in FIG. 4 the housing 33 also includes channel-shaped members including vertical flanges 37 and having vertical webs 38. Vertical plate supports 39 are also supported within the box-like housing 33. As best shown in FIGS. 4 and 7, one side of the housing 33 supports a coupler pin 40 having a recess or bayonet-type slot 41. Each coupler pin 40 has a tapered end 42 and an inner cylindrical shank 43 which is suitably supported within the housing by the vertical supports 39 and channel-shaped vertical flanges 37. Each housing 33 also includes an elongated receptacle 44 laterally spaced from the coupler pin 40 and includes a tube 45 having a flaired receiving end 46. Each of the coupler housings 33 is provided with a central electrical carry-through connector 47 of conventional design which is not further described.

Referring now particularly to FIGS. 3, 4 and a coupler shank 48 includes a head portion 49 which is centrally disposed within the housing 33 between the respective webs 38. The head portion 49 includes an undercut recess 50 and is provided with a shank extension 51 provided at its end with a pair of spaced ears 52 which are interconnected by means of a pivot pin 54 to a link 53. The link 53 has at one end an enlarged slot 55 through which extends a shaft 56 which is suitably supported on a pivot support member 57. The pivot support member 57 has a yoke construction including upper and lower pivot lugs 58 and 59, respectively. The pivot support member 57 also has connected thereto on opposite sides thereof angle shaped members 60 having horizontal flanges 61 and downwardly extending vertical flanges 62. Bolt and nut assemblies 63 suitably connect the horizontal flanges 61 to rigidly support the angle shaped members 60 on the pivot support member 57. Springs 64 are threaded on to the shaft 56 which is supported on the vertical flanges 62. The springs 64 are held captive by means of the vertical flanges 62 against the link 53 and provide for centering of the swinging coupler in its horizontal swinging movement.

The pivot support member 57 is also provided with a projecting nose end 65, as best shown in FIG. 4, which has connected thereto a pivot pin 66 which in turn is connected to a yoke 67 connected to one end of a piston rod 68. The piston rod 68 extends into a suitable hydraulic or fluid extensible cylinder 69 which is suitably connected to the tray structure 23. As best shown in FIGS. 3 and 6 the tray structure 23 is connected against sliding movement to the flanges 19 of the supporting frame structure 18 by means of shear pins 70.

As shown in FIGS. 3, 4 and 5 a vertical pivot shaft or member 71 includes a central semi-spherical bearing portion 72 and is rigidly supported within and connected to the upper and lower pivot lugs 58 and 59, respectively. The semi-spherical bearing 72 is contained in bearing relation with a cylindrical bearing portion 73 provided on the shank extension 51. Washer type spacers 74 are supported on the pivot shaft 71 and are in engagement with upper and lower arms or straps 75 and 76 which are connected at their forward ends to a vertical shaft 77 extending through and being connected to the forward end of the coupler shank 48 in the vicinity of the head portion 49 and undercut recess 50. Upper and lower springs 78 and 79, respectively are positioned on the shaft 77 so as to provide for vertical centering of the housing 33 and coupler pin 40. The housing is automatically centered in its vertical movement in response to the biasing action of the springs 78 and 79. As best shown in FIGS. 3, 5 and 6, guide lugs 80 provided on the upper and lower pivot lugs 58 and 59 are in sliding and confined engagement with respect to the upper and lower channel guides 31 and 32, respectively. A honeycomb cushion structure 81 is supported on a channel frame 18 by means of a plurality of angles 82. Angles 82 receive securing brackets 83 connected to the sides of the cushion 81. Securing members 84 provide for attachment of the cushion structure 81 to the angles 82. The cushion structure 81 includes an impact face 85 at one end and at its other end is provided with reinforcing gussets 86 which are rigidly secured to the center sill structure 13.

Referring particularly to FIG. 7 a locking arrangement 87 is supported on each of the box-like housing 33 of the coupler assemblies 17. The locking housings includes side walls 88 connected to an angle wall 89, both walls being connected to the vertical flanges 37 of the channel shaped members. An internally threaded tube 90 is suitably supported on the tube 45 and communicates interiorly therewith through the opening 91 in tube 45. A tubular locking pin 92 includes a threaded shank 93 which is adapted to engage in threaded relation for reciprocating movement the internally threaded tube 90. A drive sleeve 95 is rotatably positioned, and rotated by means of a shaft 97. The drive sleeve 95 includes an elongated slot 96 which is slidingly engaged by a pin 94 projecting outwardly from the threaded shank 93. An electric motor 98 rotates the shaft 97 and in turn rotating the drive sleeve 95 causing rotation of the pin 94 and reciprocation of the tubular locking pin 92 depending upon the clockwise or counterclockwise rotation of the motor 98, whereupon the locking pin 92 is reciprocated into and out of locking engagement with respect to the coupler pin 40 as best shown in FIG. 7.

THE OPERATION

Figure 2:
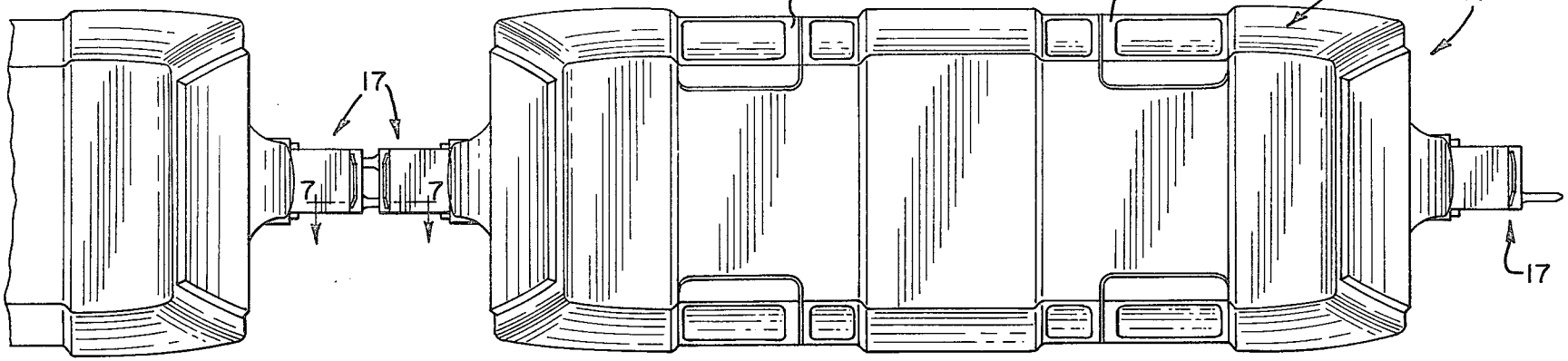
FIG. 2 is a plan view of the vehicles disclosed in FIG. 1.

In FIG. 7 the coupler pin 40 is shown in coupled relation with respect to the tube 45 and the interconnection of the cars is of course evident from FIGS. 1 and 2. The operation of the locking motor and housing 87 has been described. The advantage of the present construction is that the coupler will be able to couple and uncouple on a 30 foot radius curve by virtue of the spherical bearing arrangement allowing the coupler to move horizontally 25 degrees on either side of the vehicle center line and vertically three and one-half degrees up or down. The springs 78 and 79 will center the vertical or up and down positioning of the coupler whereas the springs 64 will center horizontal movement of the coupler. As the coupler head and housing swing vertically up and down the link 53 is pivoted relative to the pivot pin 54 and the relative sliding movement permitted by the elongated slot in the link relative to the shaft 56 permits the upward and downward swinging movement. Yet when the coupler is swung horizontally the springs 64 will again effectuate the centering movement of the coupler head and coupler housing.

During coupling with relatively lesser impacts up to five miles per hour the hydraulic shock absorber or extensible device 69 will absorb the impacts. The coupler housing and associated structure including the pivot support member 57 will move rearwardly which in turn will move the nose 65 and piston rods 68 relative to the hydraulic cylinder for absorbing the impact against the coupler assembly. This movement will be guided by the channel guides 31 and 32 which receive the slide lugs 80 supported on the pivot support member 57. After absorption of the shock the hydraulic shock absorber will return the coupler assembly to its normal position. During these impacts up to five miles per hour the shear pins 70 will fixedly contain the tray structure 23 and associated parts in the position indicated relative to the supporting channel frame structure 18. At impacts over the five mile per hour limit which are absorbed by the hydraulic shock absorber these shear pins 70 will be sheared and the whole assembly will be free to move, in which case the slide supports 30 will slidingly move on the slide guides 21 along the frame structure 18. When this occurs the honeycomb shock absorber 81 will be effective to absorb the higher speed impacts. The honeycomb type of shock absorber 81, which may be of crushable or resilient materials, is standard in the art and the interior details need not further be described. The secondary cushioned structure therefor provides increased protection and as the shear pins are severed during the higher speed impacts the coupler structures will remain relatively undamaged and the secondary cushioned structure and underframe structure will absorb the additional over speed impacts.

What is claimed is:

1. An end of car coupling arrangement for railway cars including a supporting frame mounted on the end of said car, a coupler structure including a box-like housing having a coupler pin projecting outwardly therefrom, said housing including a receptacle laterally spaced from said coupler pin for receiving the coupler pin of a connected car, means slideably supporting said coupler structure on said supporting frame, the improvement comprising;

a shank connected to said coupler housing and projecting rearwardly therefrom, a pivot support member slideably supported on said supporting frame, upper and lower pivot lugs on said pivot support member, a vertical pivot shaft supported on said lugs, bearing means connecting said shank and coupler housing to said shaft for horizontal swinging movement from a center position about a vertical axis, means pivotally connecting one end of said shank to said pivot support member whereby said shank and coupler housing may be swung vertically about said bearing means from said center position, and biasing means for returning said coupler shank to said center position.

2. The invention in accordance with claim 1, said bearing means including a spherical bearing on said pivot shaft, and said shank having a complemental bearing element supported on said spherical bearing.

3. The invention in accordance with claim 1, said biasing means including an horizontal spring means engaging one end of said shank on one side of said pivot shaft, and a vertical spring means connected to the other end of said shank on the other side of said pivot shaft.

4. The invention in accordance with claim 3, said horizontal spring means including a bracket connected to said pivot support member, said bracket having spaced vertical ears, a spring support shaft supported on said ears, a link pivotally connected to one end of said shank, said link being pivotally connected to said spring support shaft, and spring elements held captive between said ears and said link.

5. The invention in accordance with claim 4, said vertical spring means including upper and lower spring retainer arms mounted on said vertical pivot shaft, and a vertical spring retainer shaft connected to said lugs and pivotally connected to said shank, and second spring elements held captive between said arms and said shank.

6. The invention in accordance with claim 4, said link being connected to said spring support shaft by means of an elongated sliding connection.

7. The invention in accordance with claim 1, including cushioning means connecting said supporting frame and said coupler shank.

8. The invention in accordance with claim 7, said cushioning means including a fluid extensible device, having a piston rod and being supported on said supporting frame, and means pivotally connecting said piston rod to said pivot support member for sliding movement therewith.

9. The invention in accordance with claim 7, including a second cushioning means supported on said car above said first cushioning means.

10. The invention in accordance with claim 9, said second cushioning means being mounted on said supporting frame and projecting longitudinally outwardly of said car relative to said first cushioning means.

11. The invention in accordance with claim 1, said supporting frame including a first frame portion having downwardly extending horizontally spaced support plates rigidly connected to said railway car, horizontal slide guides on said vertical plates, second frame portion on said supporting frame, said second frame portion including second horizontally spaced vertical plates including slide members slideably supported on said slide guides, and a tray including a horizontal platform suspended from said second vertical plates for supporting said coupler structure.

12. The invention in accordance with claim 11, said tray and second frame vertical plates being restrained against sliding movement relative to said first vertical plates and first frame portion by shear pin means interconnecting said first and second frame portions.

13. The invention in accordance with claim 1, said supporting frame including first and second frame portions, said second frame portion being supported on said first frame portion and including horizontal spaced vertical plates and a top plate connecting said spaced vertical plates, a horizontal platform connected to a lower portion of said spaced vertical plates, said means slideably supporting said coupler structure including upper and lower guide means on said top plate and platform, and upper and lower slide means on said pivot support member slidingly engaging said guide means.

14. The invention in accordance with claim 1, said coupler pin comprising a cylindrical tapered end portion, a recessed slot on said pin spaced from said end portion, said receptacle of said housing including a tubular elongated member having a recess adapted to register with said recessed slot, a locking arrangement having a tubular portion registering with said recess, and locking means movable in said tubular portion through said recess into said recessed slot for locking the coupler pin of a connected car within said receptacle.

15. The invention in accordance with claim 14, said tubular elongated member having internal threads, and said locking means having external threads engagable with said internal threads whereby during rotation of said loading means the same is reciprocated in said tubular elongated member.

16. The invention in accordance with claim 15, including motor means for rotating said locking means.

* * * * *